US008235215B2

(12) United States Patent
Tomasello et al.

(10) Patent No.: US 8,235,215 B2
(45) Date of Patent: Aug. 7, 2012

(54) GIFT PAIL KIT

(76) Inventors: Melinda K. Tomasello, Oviedo, FL (US); Pamela A. Grimes, Stafford, VA (US)

( * ) Notice: Subject to any disclaimer, the term of this patent is extended or adjusted under 35 U.S.C. 154(b) by 294 days.

(21) Appl. No.: 12/656,461

(22) Filed: Jan. 29, 2010

(65) Prior Publication Data

US 2010/0213098 A1 Aug. 26, 2010

Related U.S. Application Data

(60) Provisional application No. 61/202,390, filed on Feb. 24, 2009.

(51) Int. Cl.
*B65D 69/00* (2006.01)

(52) U.S. Cl. ..... 206/575; 206/232; 206/457; 206/459.5

(58) Field of Classification Search ..... 206/223, 206/232, 457, 575, 769, 770, 459.5, 577
See application file for complete search history.

(56) References Cited

U.S. PATENT DOCUMENTS

| | | | | |
|---|---|---|---|---|
| 4,836,437 | A * | 6/1989 | Kirschner | 206/457 |
| 5,487,467 | A * | 1/1996 | Sherman | 206/216 |
| 6,638,133 | B1 * | 10/2003 | Brancolino et al. | 206/457 |
| 2004/0104140 | A1 | 6/2004 | Reilly | |
| 2005/0011792 | A1 * | 1/2005 | Scott | 206/457 |
| 2006/0060488 | A1 | 3/2006 | Rodriguez | |
| 2007/0034545 | A1 * | 2/2007 | Sabalaskey et al. | 206/575 |
| 2007/0039849 | A1 * | 2/2007 | Rodriguez | 206/457 |
| 2009/0050505 | A1 * | 2/2009 | Rubin | 206/232 |
| 2009/0120816 | A1 * | 5/2009 | Ruman et al. | 206/232 |

OTHER PUBLICATIONS

*Paper Wishes*, www.paperwishes.com/products/4009249, Paper Wishes, 1 page, Oct. 3, 2008.

* cited by examiner

*Primary Examiner* — Luan K Bui
(74) *Attorney, Agent, or Firm* — Richard C. Litman

(57) ABSTRACT

The gift pail kit allows a user to create a personalized gift package without the need for special creative or artistic talents. The kit includes a container (pail), shred packing material, facial expression transfer stickers, a hairpiece, a gift label, a note card and an instruction booklet. As presently contemplated, the pail will be offered in seven different hair color choices. The shred material may be colored to match the hair color. The pails may be offered in various sizes, and the kit will be fabricated from recyclable and eco-friendly materials.

2 Claims, 4 Drawing Sheets

GIFT PAIL KIT

CROSS-REFERENCE TO RELATED APPLICATION

This application claims the benefit of U.S. Provisional Patent Application Ser. No. 61/202,390, filed Feb. 24, 2009.

BACKGROUND OF THE INVENTION

1. Field of the Invention

The present invention generally relates to artistic paraphernalia, and more particularly to a gift pail kit containing materials needed to create a personalized gift container.

2. Description of the Related Art

On many occasions (graduations, anniversaries, weddings, birthdays, etc.) it is customary to present a gift. Usually, the gift is wrapped in festive paper or housed in a gift bag, box or basket that is adorned with brightly colored ribbons and/or bows. This conventional type of gift presentation is becoming passé in that it lacks the creativity, excitement and personalization that is currently wanted and emphasized by consumers. The marketplace would certainly embrace gift packaging that would permit the presenter to personalize the packaging in a manner to add the above noted creativity and excitement to the packaging. Thus, a gift pail kit solving the aforementioned problems is desired.

SUMMARY OF THE INVENTION

The gift pail kit allows a user to create a personalized gift package without the need for special creative or artistic talents. The kit includes a container (pail), shred packing material, facial expression transfer stickers, a hairpiece, a gift label, a note card and an instruction booklet. As presently contemplated, the kit will be offered in seven different hair color choices. More or fewer choices may be made available as the market demands. Preferably, the shred material will be colored to match the hair color. It should be noted, however, that different and varied color combinations of the hair and shred can be utilized if desired. The pails may be offered in various sizes and the kit will be fabricated from recyclable and/or eco-friendly materials.

Accordingly, the invention presents a kit that allows a user to easily fabricate a gift package that emphasizes uniqueness and originality. The kit is designed to generate individual creativity and fun. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
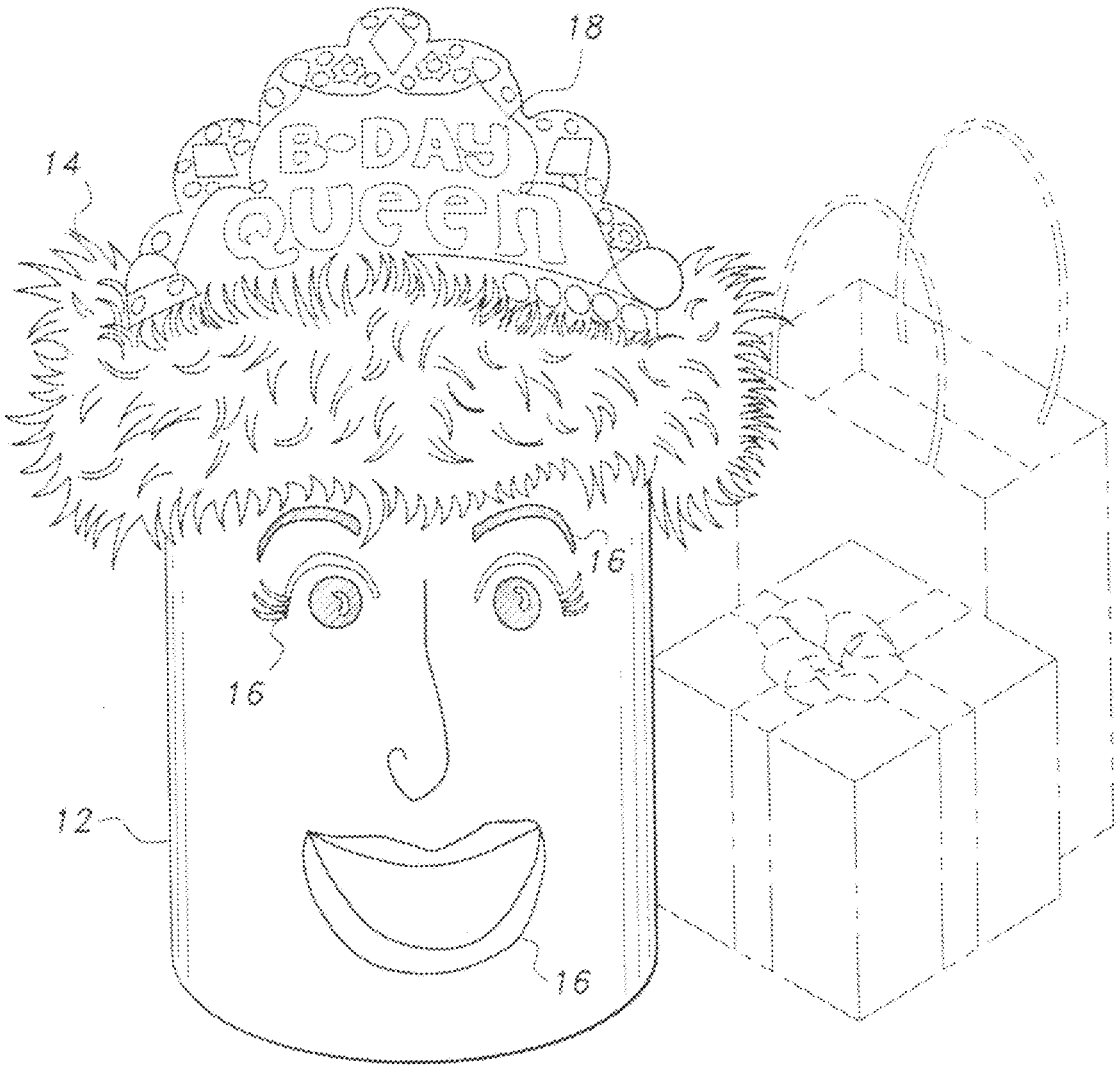
FIG. 1 is an environmental, perspective view of a gift pail kit according to the present invention.
Figure 2A:
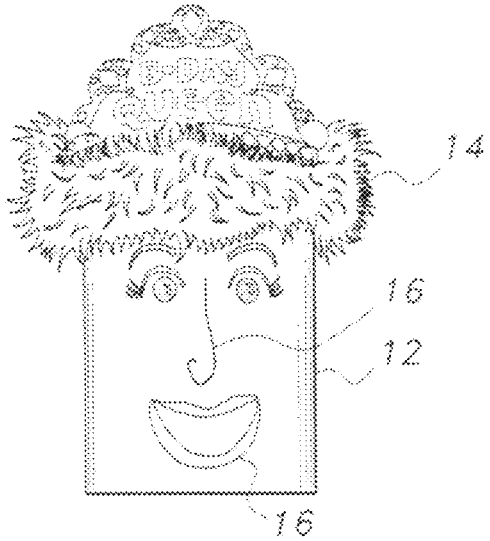
FIG. 2A is a front view of a first embodiment of a gift pail kit according to the present invention.
Figure 2B:
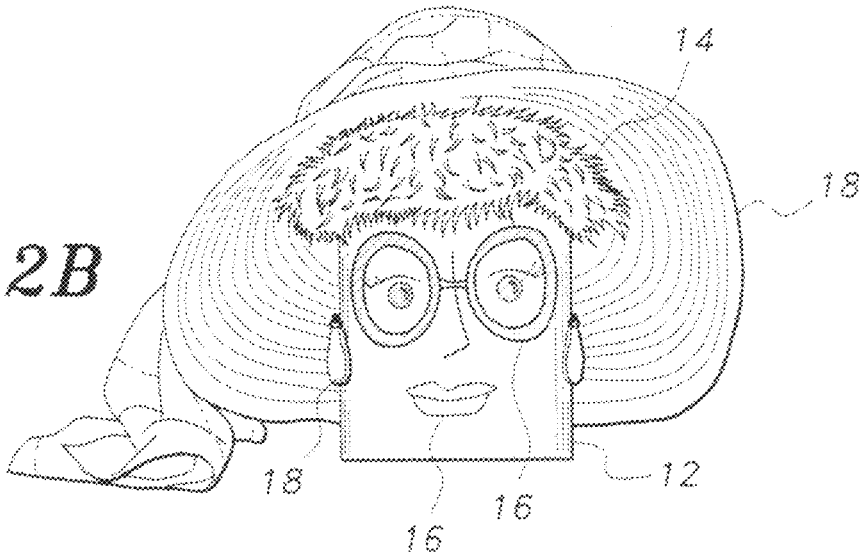
FIG. 2B is a front view of a second embodiment of a gift pail kit according to the present invention.
Figure 2C:
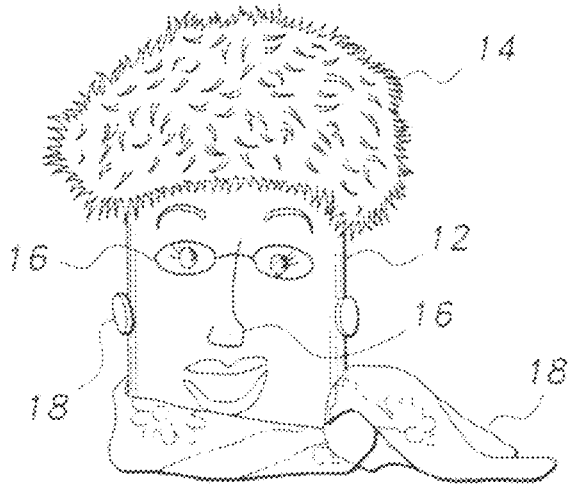
FIG. 2C is a front view of a third embodiment of a gift pail kit according to the present invention.

As shown in FIGS. 1-2C, the gift pail kit is shown in post-decorated form and comprises a pail 12 topped with a hairpiece 14. Selected transfer stickers 16 are disposed on the outer surface of the pail to replicate the eyes, nose and mouth of the created persona. The transfer stickers 16 are peeled from a sheet and are reusable. Fashion accessories 18 (glasses, sunshades, earrings, scarves, hats, etc.) may be employed to personalize the character of the created persona. It should be noted that the fashion accessories are not included in the gift kit. It is recommended that old or about-to-be-discarded accessories be used to attain the desired decorative effect. Besides being economical, the use of such accessories will add a certain unique personal quality to the decorative effect.

Figure 3:
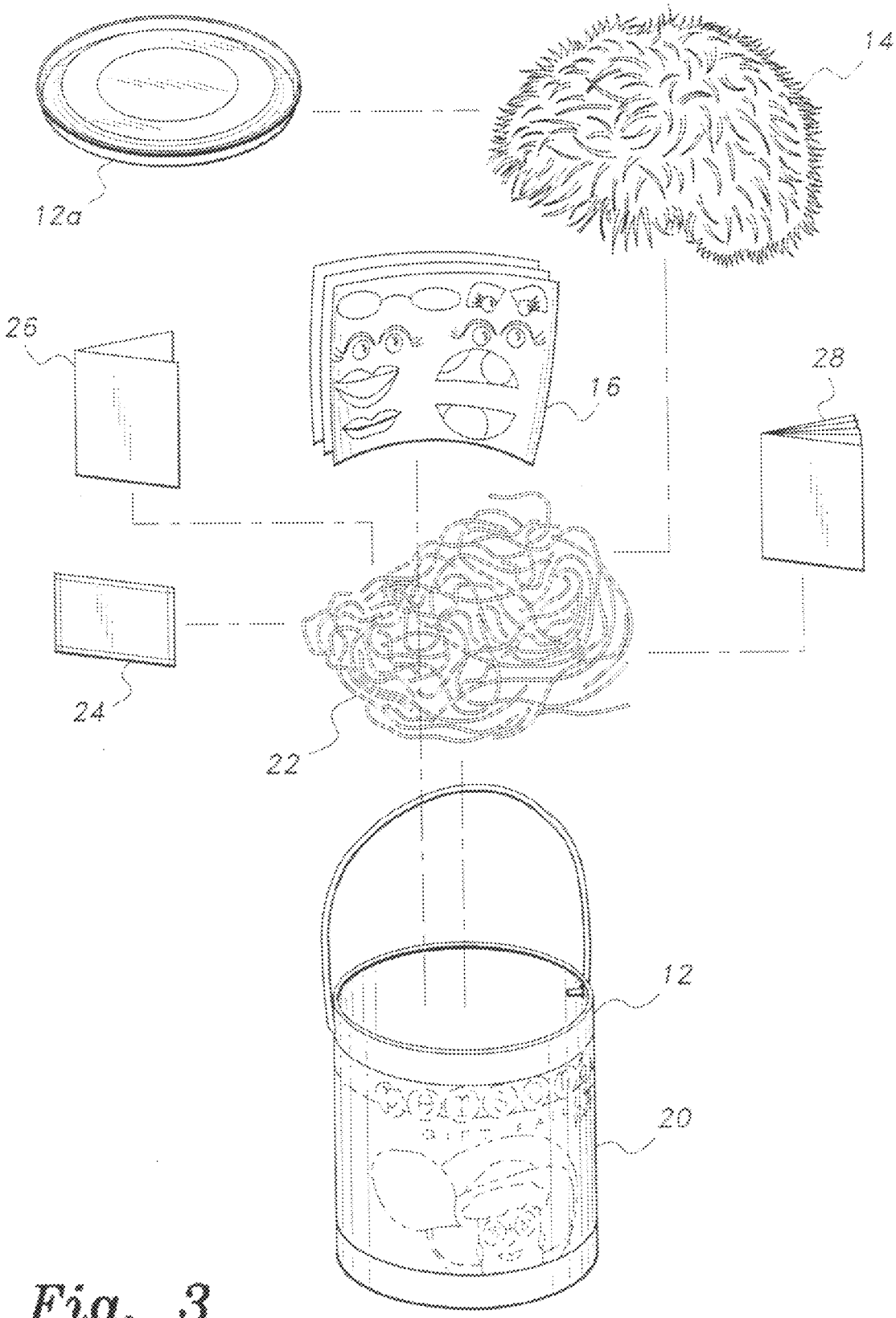
FIG. 3 is an exploded perspective view of a gift pail kit and its contents according to the present invention.

FIG. 3 is an exploded view of the contents of the gift pail 12. In its pre-decorative state, the outer surface of the pail is encompassed with a removable label 20. The label will indicate (among other things) the color of the hairpiece 14 (and shred 22) and exhibit a sampling of the various persona that are possible when decorating the pail 12. Access to a website is also disposed on the label 20 to aid a user if needed. The contents of the gift pail 12 include a hairpiece 14, an array of persona transfer stickers 16, packing shred 22, gift label 24, note card 26 and instruction booklet 28. The contents are housed in the pail 12, and the pail is closed by means of a lid 12*a*.

Figure 4:
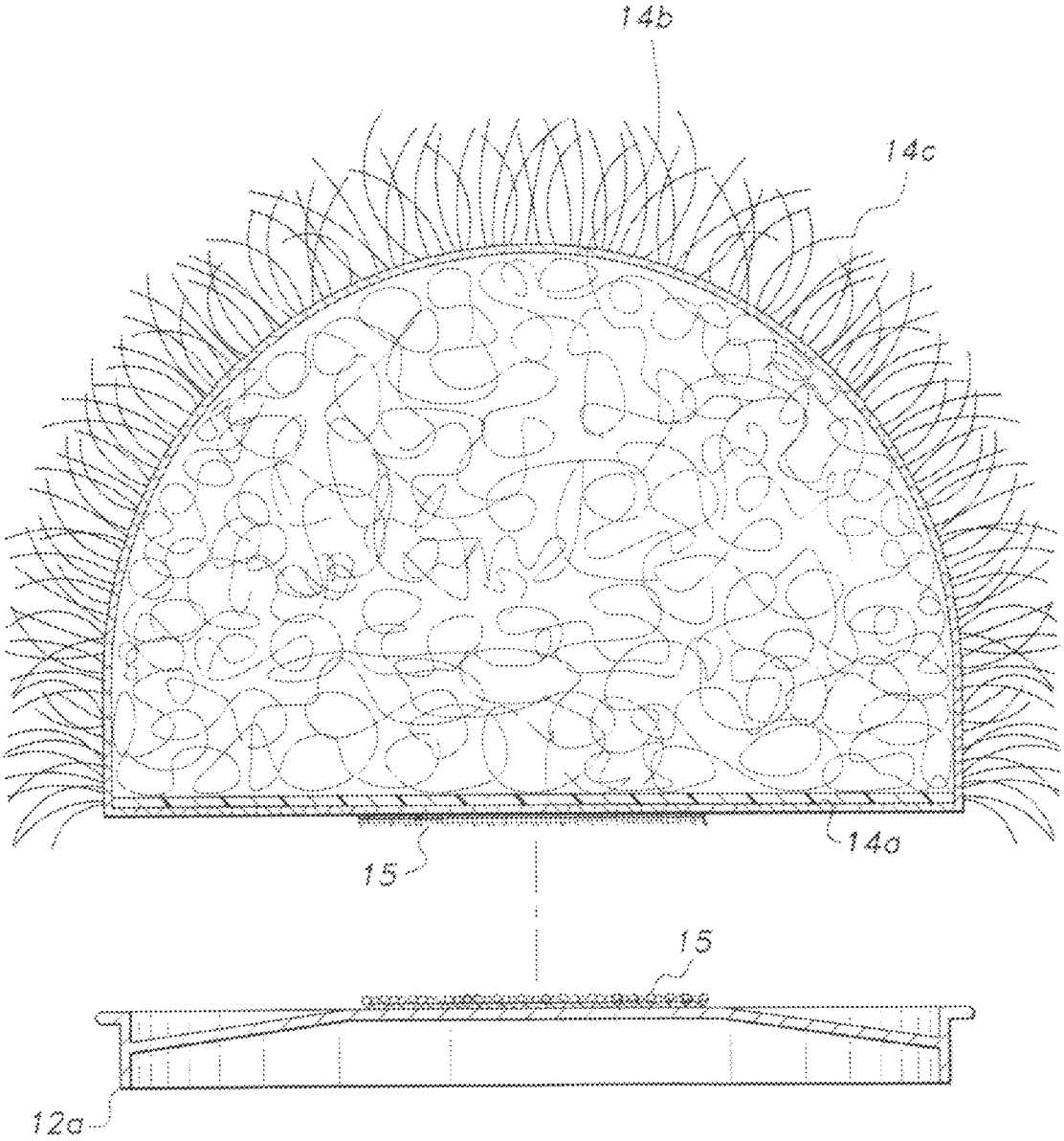
FIG. 4 is a front section view of the hairpiece of a gift pail kit according to the present invention.

FIG. 4 shows the construction of hairpiece 14. The hairpiece comprises a hemispherical member having a base 14*a* fabricated from a stiff rubberized material or the like. The interior of the hairpiece 14 is filled with a conventional batting material 14*b*. The outer surface of the hairpiece 14 is covered with a synthetic, non-shedding, feather-like material to simulate hair as shown in 14*c*. Note that various high-pile fabrics and other materials will be used to achieve different hairstyles, looks and personalities. The hairpiece 14 will have dimensions to permit it to fit the top of the pail 12. Hook and loop fasteners 15 are provided for the undersurface of base 14*a* and the top surface of lid 12*a* to firmly secure the hairpiece to the gift pail. Conventional release paper (not shown) is used to cover the hook and loop fasteners until ready for use.

It is to be understood that the present invention is not limited to the embodiments described above, but encompasses any and all embodiments within the scope of the following claims.

We claim:

1. A persona craft kit, comprising:

a container, the container having an open top, a closed bottom and an outer surface;

a removable lid selectively closing the open top, the removable lid having a continuous top surface; and a plurality of items housed in the container adapted for attachment to the container to create a decorative package with a persona selected by a user, the plurality of items including a hairpiece, shred packing material, removable persona transfer labels, a gift label, a note card and an instruction booklet, wherein the hairpiece comprises a hemispherical member having a hollow interior and a base, the base being fabricated from a stiff, rubberized material and having an undersurface, a batting material disposed in the hollow interior of the hemispherical member, further wherein hook and loop fasteners are disposed on the undersurface of the base and the top surface of the lid thereby securing the hairpiece to the lid.

2. The gift packaging kit according to claim 1, wherein said hairpiece and said shred packing material are of the same color.

* * * * *